US005617826A

United States Patent [19]

Brandt

[11] Patent Number: 5,617,826

[45] Date of Patent: Apr. 8, 1997

[54] SYNCHRONIZED COMPRESSION IGNITION ENGINE

[75] Inventor: James B. Brandt, Clyman, Wis.

[73] Assignee: Performance Corporation, Clyman, Wis.

[21] Appl. No.: 383,989

[22] Filed: Feb. 6, 1995

[51] Int. Cl.[6] ..... F02D 1/02

[52] U.S. Cl. ..... 123/450; 123/501

[58] Field of Search ..... 123/446, 447, 123/450, 501, 502

[56] References Cited

U.S. PATENT DOCUMENTS

| | | | |
|---|---|---|---|
| 1,770,861 | 7/1930 | Rathbun | 123/450 |
| 2,742,050 | 4/1956 | Gray et al. | 123/450 X |
| 3,401,572 | 9/1968 | Bailey | 123/501 X |
| 3,664,318 | 5/1972 | Giuffra | 123/450 |
| 4,040,405 | 8/1977 | Tanaka et al. | 123/450 |
| 4,043,307 | 8/1977 | Noguchi et al. | 123/450 X |
| 4,164,923 | 8/1979 | Kimata et al. | 123/450 X |
| 4,200,074 | 4/1980 | Kosuda et al. | 123/450 X |
| 4,215,662 | 8/1980 | Nozaki et al. | 123/447 |
| 4,638,782 | 1/1987 | Yasuhara et al. | 123/502 |

*Primary Examiner*—Tony M. Argenbright

[57] ABSTRACT

The primary function and purpose of a synchronized engine is, by transposing internal chemical energy of liquid and gaseous fuel, to produce rotational power and energy by adjusting the characteristics of combustion, using a rotary fuel distributor so that injection occurs at the most critical instant of piston to crankshaft mechanical positioning while taking into account all measureable, calculateable, and estimateable influences of its environment. Thus the synchronous compression engines of, four cycle and two cycle, any cylinder configuration, are exemplary engines capable of reliable operation with a synchronized combustion control unit operating in synchronization (astrosynchronization) with the rotation of crankshaft and resulting combustion cycle position of piston to charge combustion chamber with atomized fuel during the most advantageous degree span for the perplexity of conditions encountered,

2 Claims, 4 Drawing Sheets

SYNCHRONIZED COMPRESSION IGNITION ENGINE

CROSS REFERENCE TO RELATED APPLICATIONS

The invention of this application is related to and a functional complement to my invention and patent VARIABLE SPEED AND DIRECTION TRANSMISSION PRIME MOVER SYSTEM, U.S. Pat. No. 4,014,222 dated Mar. 29, 1977; fluid power, hydraulic system; and additional transmission and fluid systems.

Richard Whittle describes fluid flow through an orifice in U.S. Pat. No. 2,971,585 called "Sequencing And Pressure Reducing Valve Utilizing V-Shaped Orifice To Effect Pressure And Gain Regulation" patented Feb. 14, 1961. S. J. Rovinsky's has "Regulating Valve" U.S. Pat. No. 2,067,346 employing restriction control of fluids.

BACKGROUND

1. Field of Invention

This invention relates to the synchronized compression ignition engine in which combustion, adjustment control is maintained as high pressure fuel is injected to maximize operating characteristics; into hot compressed air or other combustion supporting media during every other or every rotation to cause expansion of the chemically correct (or nearly chemically correct) mixture to transmit power to a piston-connecting rod-crankshaft-flywheel linkage thus producing rotational power.

2. Description of Prior Art

Automobiles (cars, vans, light trucks, emergency vehicles, racing vehicles, rtvs, etc.), trucks, buses, mobile equipment (such as construction, industrial, mining, rail, airpod, boats, ships, farming, etc.) recreation machines, motor bicycles, light aircraft, etc. require some type prime mover system to transform liquid and/or gaseous fuel to motion and by that to supply motive power to transmissions, wheels, tracks, sprockets, or other means of propulsion. Other machines such as generators, welders, pumps, power tools, etc. require this type of prime mover for same mode of rotational power for operation.

Prime movers to convert liquid and/or gases that can liberate their chemical structure by mixing into a chemically or ready chemically correct volume of compressed air, oxygen, or other fluid to cause a chemically reaction to progress and thus expand in a finite period, to produce rotational power have been envisioned for several hundred years. Many forms, of both internal and external combustion, have been successfully designed, built, and manufactured for transportation, to do work, and to supply energy, etc. Their success being dependent on their efficiency, energy liberation rate, power to weight ratio, and toilerability to the waste and/or exhaust by products. The most significant results in all these aspects have been the internal combustion engines of two basic constructs. The piston to crank is the most widely used. The other is the combustion turbine.

The piston to crank is best suited to power the bulk of equipment because it best acceleration, better torque characteristic, and better efficiency. It is much worse in power to weight characteristics. Also, it cannot be used for power in confined areas and volumes. Automobiles, vans, rtv's, low tonnage, light trucks, lift trucks, etc. are restricted to four cycle because it is less polluting, where as semi, dozers, turnapults, loaders, backhoe, graders, buckets, medium and large trucks, and the like are to be constructed of either two or four cycle with very large usually two cycle due to inertia of operating parts.

Further more this invention relates to synchronous, combustion, control prime movers which simultaneously ignite by spark the fuel and air and/or oxygen mixture so that a lower maximum pressure results that a lighter construction can result. Also additional control is exercised in the combustion process to control the exhaust chemical ratios and reduce operational combustion shocks. Spark ignition has been developing in conjunction with compression ignition resulting in a proliferation of both.

The past one hundred and fifty years has brought continued improvements in areas of the engine systems that improve the continued operation of engines including fuel pressurization, utilizing of different fuels, mixing of fuel types, preparation, and ignition; turbo charging with turbocharger, supercharger, and lobe blower for greater air density; lubrication; cooling with liquids and air, bearing durability; construction materials; valving of intake and exhaust from the combustion chamber. Valving type and valving control methods are a critical aspect because they determine energy loses resulting from the rapid flow, high pressure, and elevated temperature of gases in very short intervals. Much development is progressing in more durable materials for bearings and construction of adiabatic parts to elevate combustion temperatures and reduce heat transfer away from expanding and resultant expanding working combustion mixture.

OBJECTS AND ADVANTAGES

Accordingly, several objects and advantages of my invention are to provide synchronized compression ignition engines in which high pressure fuel is controllably injected into hot compressed air or other combustion supporting media during a finite crankshaft rotation to maximize operating characteristics of output power, efficiency, exhaust gas constituents, and weight under various conditions of intake density, temperature, humidity, combustion progression, altitude, speed, and torque.

Accordingly, several objects and advantages of my invention are to provide synchronized compression ignition engines in which high pressure fuel is controllably injected into hot compressed air or other combustion supporting media during a finite part of every second crankshaft rotation to maximize operating characteristics of output power, efficiency, exhaust gas constituents, and weight under various conditions of intake density, temperature, humidity, combustion progression, altitude, speed, and torque.

Accordingly, several objects and advantages of my invention are to provide synchronized compression ignition engines in which high pressure fuel is controllably injected into hot compressed air or other combustion supporting media during a finite part, of every crankshaft rotation to maximize operating characteristics of output power, efficiency, exhaust gas constituents, and weight under various conditions of intake density, temperature, humidity, combustion progression, altitude, speed, and torque.

Accordingly, several objects and advantages of my invention are to provide synchronized spark ignition engines in which pressurized fuel is controllably injected into hot compressed or intake manifold air or other combustion supporting media during every second crankshaft rotation to maximize operating characteristics of output power, efficiency, exhaust gas constituents, and weight under various conditions of intake density, temperature, humidity, altitude, combustion rate,speed, and torque.

Accordingly, several objects and advantages of my invention are to provide synchronized spark ignition engines in which pressurized fuel is controllably injected into hot compressed or intake manifold air or other combustion supporting media during every crankshaft rotation to maximize operating characteristics of output power, efficiency, exhaust gas constituents, and weight under various conditions of intake density, temperature, humidity, altitude, combustion rate,speed, and torque.

Still further objects and advantages will become apparent from a consideration of the ensuing description and accompanying drawings.

Accordingly, several objects and advantages of my invention are to provide synchronized, rotating lobe compression ignition engines in which pressurized fuel is controllably injected into hot compressed or intake manifold air or other combustion supporting media during every or every other crankshaft rotation to maximize operating characteristics of output power, efficiency, exhaust gas constituents, and weight under various conditions of intake density, temperature, humidity, altitude, combustion rate, speed, and torque.

Accordingly, several objects and advantages of my invention are to provide synchronized rotating lobe spark ignition engines in which pressurized fuel is controllably injected into hot compressed or intake manifold air or other combustion supporting media during every or every other crankshaft rotation to maximize operating characteristics of output power, efficiency, exhaust gas constituents, and weight under various conditions of intake density, temperature, humidity, altitude, combustion rate,speed, and torque.

Still, further objects and advantages will become apparent from a consideration of the description and accompanying drawings.

SUMMARY

Compression ignition engine with synchronization control of the combustion sequence results in a most reliable, most efficient, smoothest operating, often lighter, more reliable starting, and flexible rotational power source as the axially displacement producing rotation displacement in conjunction with supporting spline, angular displacement and counteracting spring return mechanism (dual direction hydraulic would be less stable) can input the liquid and/or gaseous fuel at the mechanically advantaged position of the piston to connecting rod and connecting rod to crankshaft providing best combustion impulse reaction at all reasonable operating conditions of air temperature, air temperature control, air density, fuel temperature, fuel temperature control, mechanical parts alignment (or in other contacts, proper misalignment), speed, power level, and fuel characteristics.

DESCRIPTION OF PREFERRED EMBODIMENT

Figure 1:
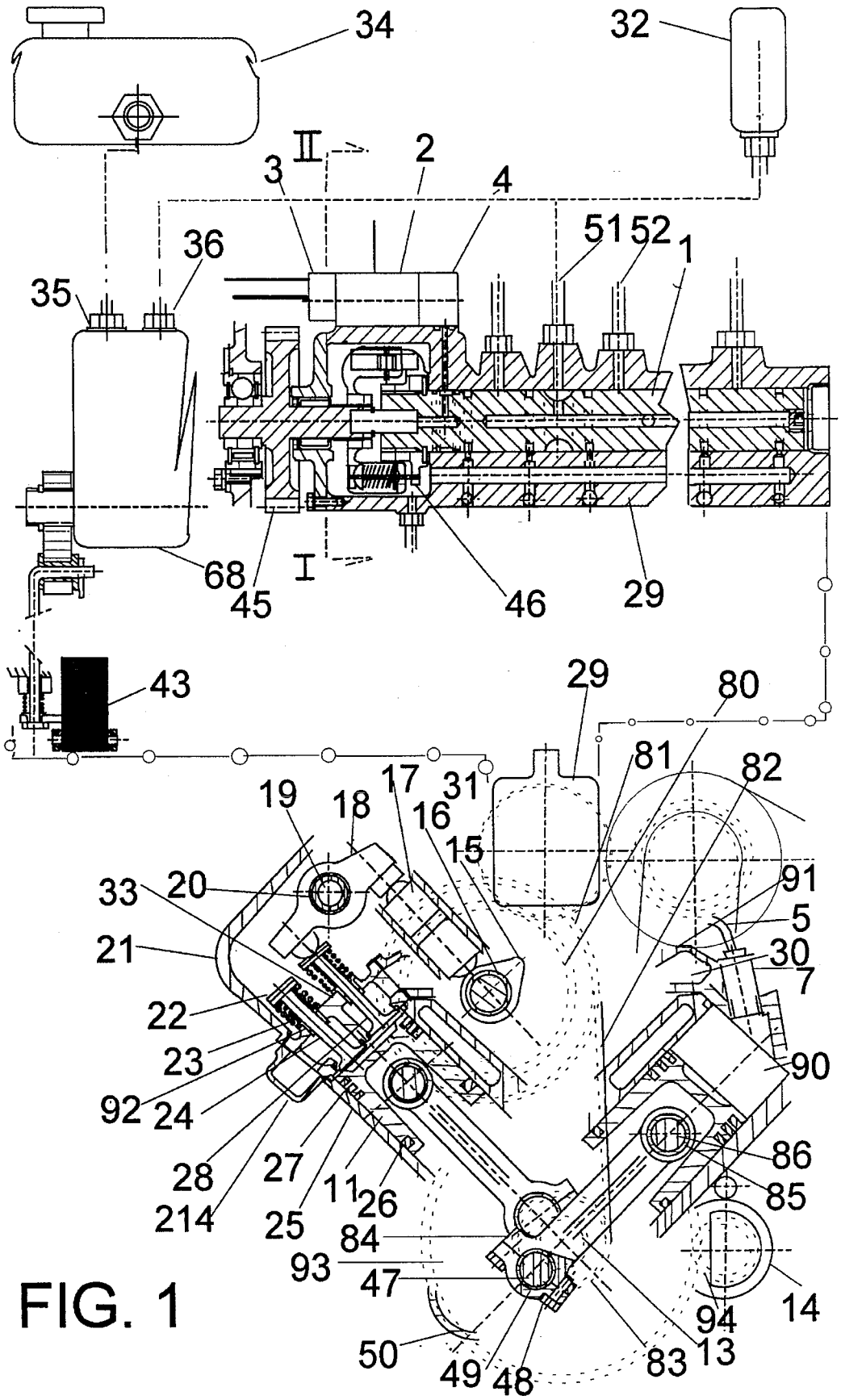
FIG. 1 is a cross-sectional representation of a four cycle synchronized compression engine with combustion synchronizing, control unit projected above.

FIG. 1 illustrates four cycle synchronized, compression ignition engine with cylinder block 25 containing the combustion chamber 90, piston 11, and connecting rod 84 driving crankshaft 47; with synchronized, combustion control unit 29 projected above. The synchronized, combustion control 29 must be positively driven by the crankshaft 47 either by helical gear 45 meshing with helical gear 80 off the camshaft 31, coupled to end of camshaft, directly by silent chain 82 by crankshaft, or by means of timing belt by crankshaft through corresponding means sheave, sprocket, or helical gear 83. Sprocket 81 is affixed to gear 80 and both are thus rotated at half crankshaft speed since timing chain 82 is powered by sprocket 83, which is half the diameter of driven sprocket 81.

Since sprockets 83 and 81 produce a two to one ratio the camshaft with cam 15 will operate the poppet valves every second crankshaft 47 rotation and at this rotation at the most advantages crankshaft rotation angle and piston (a few crank degrees before top dead center spanning to some degrees after top dead center, pending on accumulation all for mentioned conditions) synchronous control unit 29 will open an orifice in valve 1. As a result pump 68 will deliver high pressure fuel from filter and tank 34, drawing fuel in at connection 35, pressurizing usually by piston pump out connection 36. The small (fuel for one charge) Belleville, nested coil spring, or gas accumulator 32 will retain the fuel charge to compensate for necessary timing variations. The fuel charge pressurizes fuel passage 51 through passages of valve 1 to supply as many outputs 52 to cylinders; usually one, two, or three (perhaps four) depending on physical design parameters; as are practical and durable. The fuel is retained until the control groove machined in valve 1 is opened with housing 29 completing the passage to output 52 as functionally determined by computer 3 from resultant data input from all sensors in the vehicle's system. The computer calculates the proper position for angular adjuster 40 as to be effected by electric motor system 2.

Thus high pressure fuel is forced from valve port 52 to injector line 5 and through to fuel injector 7. The actual operation of injector 7 can be as a result of the fuel pressure forcing it open to the combustion chamber 90 or forced open externally by mechanical, electric, or hydraulic means causing rapid, controlled combustion and gas expansion acting on piston 11 in engine block 25, transmitting power to it, connecting rod 84, thus to crankshaft 47 and flywheel 93 and output. The objective is to get fuel mixture at maximum condition in the combustion chamber at the instant of crankshaft, rotation angle span, in volume flow rate to insure thorough mixture, and at the temperature as to maximize all conditions of the combustion process. Thus it often would include heating the fuel and intake air supply to a predetermined degree. The fuel is pump from reservoir to inlet 35 of a high pressure pump unit 68 constructed integrally with the rest of the unit 29. Engine power is input to gear or sprocket 45 at half engine speed for four cycle and input at engine speed for two cycle.

Figure 4B:
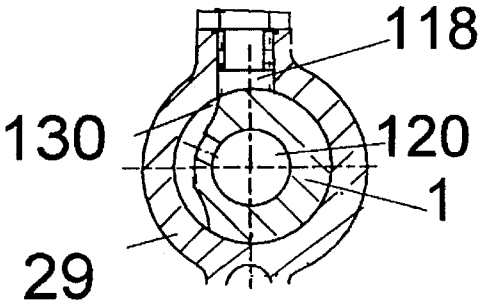
FIG. 4A illustrates SECT. III–IV of FIG. 3 through the computerized, rotational, angular, displacement, control, mechanism along with FIG. 4B illustrating SECT. V–VI of FIG. 3, the cross-sectional view of the flow valve at initialization of fuel flow.
Figure 4A:
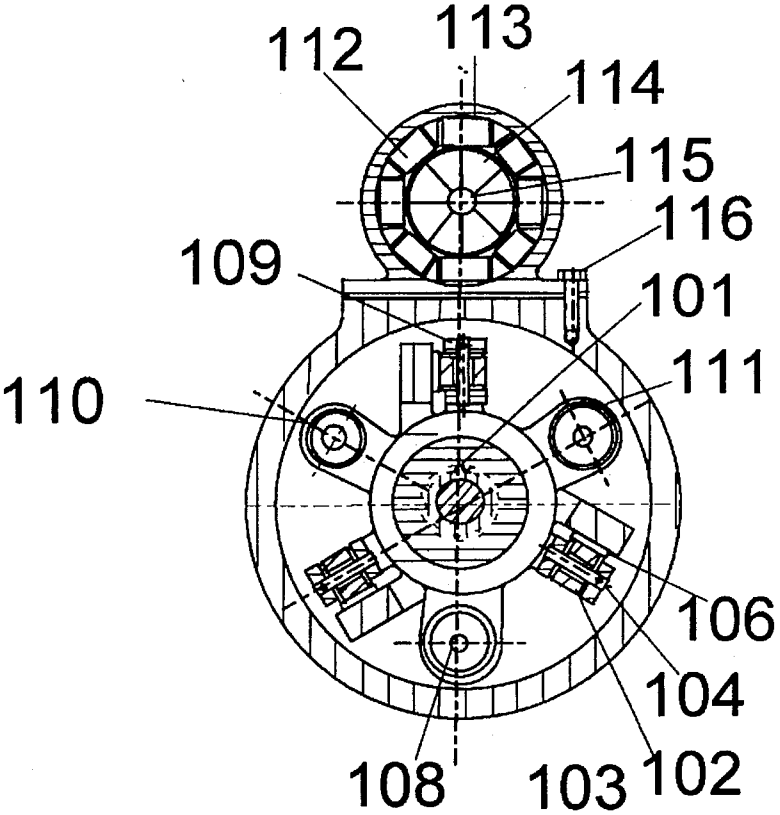

By depressing foot pedal 43 or other sliding, rotational device located any where between operator and the pump unit 68 the volume of fuel entering the pump piston to be pressurized is regulated. Foot pedal device 43 has linkage 42 to operate a volume regulator and to spring return the fuel flow rate to minimum or idle volume. Once fuel is pressurized the pressure is retained by a one-way valve mounted in each flow outlet. The one-way valve opens to release high pressure fluid from fuel passage 36 and closes to retain the pressure in accumulator 32 and to the combustion control valve. To compensate for timing variances and also to improve fuel rate delivery control to combustion a small accumulator 32 must be constructed into the fuel passage. Fuel passage 31 directs to the circular, groove valve 117 and into valve center bore 120 and then to drilled bore to each cylinder's groove 130 precision machined on the circumference. FIG. 4 shows the leading edge of these valve grooves must be located with precision with respect each other so each releases it's fuel consistently as calculated by the computer 3 for the operating conditions. A determined volume of fuel will require a determinable rotation, angle span of the valve relative to the crankshaft angle. The groove 130 cross-section can be any shape so as to best result in the required flow/time characteristic of the fuel flow, that being for practical machining V, square, rectangular, or circular. The sensors from all measurable, system conditions are entered by electric signal through cables 126 and 125 to computer 3 to control electric motor 2 or other servo device to adjust the rotation, angular adjuster mechanism. This control can be by motor controlled fluid, pressure regulator 4, mechanical lever and linkage, or electric motor control of mechanical linkage. A control governor of electric, centrifugal, or centrifugal hydraulic construction must be installed in conjunction with unit 29 or else where on the engine to transmit an engine rotational speed rate signal to the computer for regulation control and safety. The unit could be designed into multiple single units mounted on each cylinder injection point by rearranging the housing.

Figure 3:
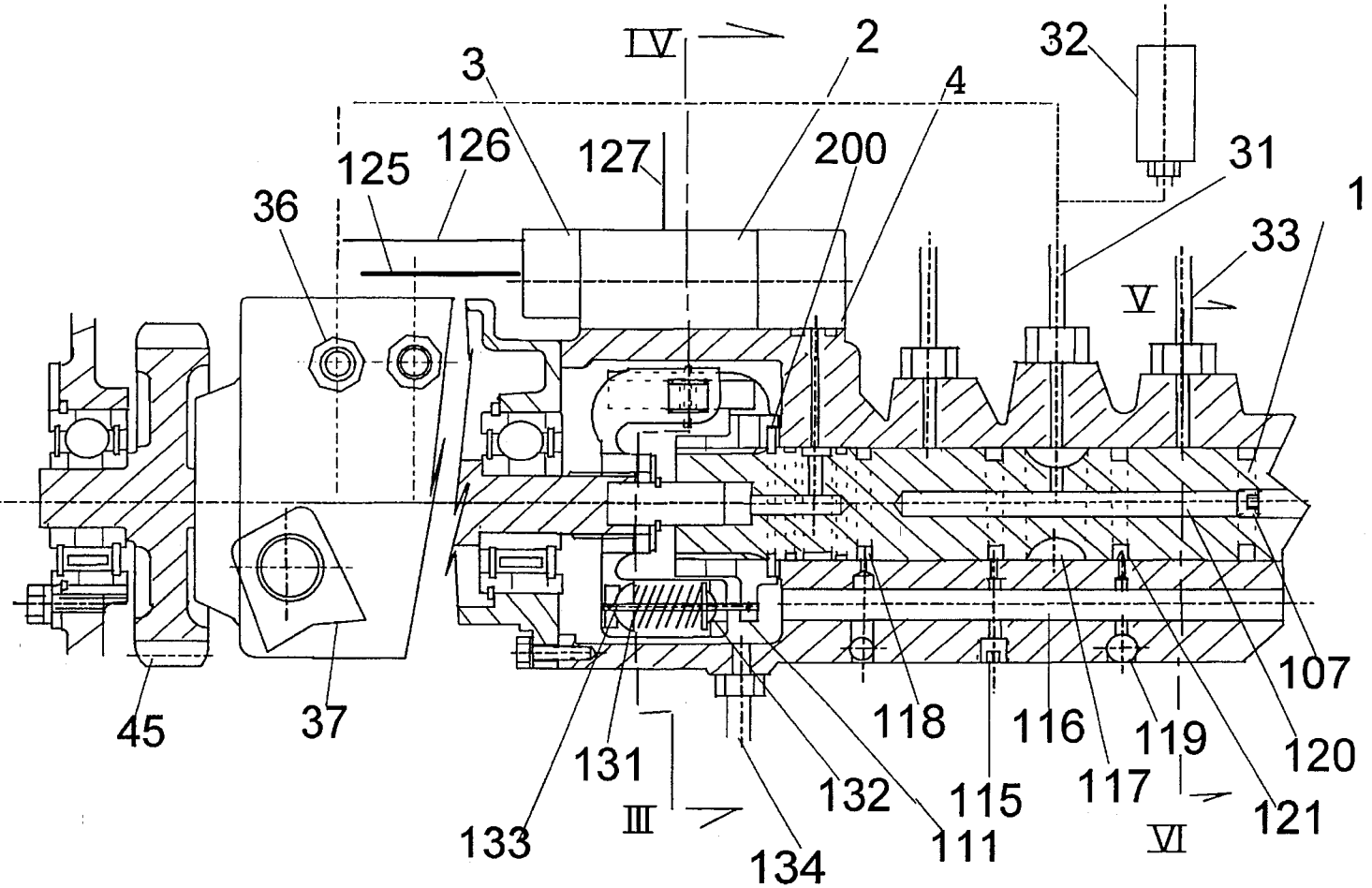
FIG. 3 shows an illustration of the synchronized, combustion control unit, SECT. I–II of FIG. 1; with a SECT. III–IV through computerized, rotational, angular displacement, control, mechanism along with SECT. V–VI the cross-sectional view through the flow control valve.

A cross-sectional view of the rotational, angular adjuster is shown in FIG. 3. The fluid or mechanical linkage acts on an axially, angulated, adjuster 109 move it in alignment to parallel adjuster 111 that has wear surface or heat treated plate 106. This motion is skewed axially as is the axially, skewed spline 101 to rotate the adjuster 111 relative to adjuster 109 which changes the timing of fuel release to the combustion chamber, thus providing adjustment up to fifty degrees or more. Adjuster 109 retains an optional anti-friction roller 102. Skewed spline 101 is machined on by angular machining with rotational motion leaving clearances for sliding with the mating spline. The sum of roller 102 and the skewed spline 101 offset angles provides the total effective mechanism angle, producing the most advantageous and effective fuel injection delivery timing. The roller 102 is rotated about pin 104 (which may have a bearing) and securely fastened into 109. To counteract the mechanism force of the computer controlled piston, return mechanism to preset position, and reduce the effect of system inefficiency is provided by one to three compression coiled springs 110. The Motor magnetic, field windings 114 and/or 112 are electrically energized by computer 3 as required to adjust the hydraulic pressure or rotate a screw mechanism with motor shaft 115. Center tension rod 108 acts to transfer spring's 110 force to ball alignment surface 131 on curved surface 133 connected to adjuster slide 109 from ball surface 132 on counter-slide 111.

Synchronous valve 1 has circumference grooves 121 to prevent fluid from crossing over leakage to other cylinder passages, compensate for wear, and permit running clearances in the housing 29 or a sleeve by draining the leakage through bore 116 to sump at 134 reducing or eliminating the pressure. At high engine speed the leakage should be very minimum because the interval is very short. Each set of high pressure in puts to valve 1 must be closed off by step boring bore 120, tapping, and inserting plugs 107 or pressed in plugs. Boring for draining grooves must likewise be sealed by plugs 115 or balls 119 pressed into the housing 29. Seal rings with recess grooves maybe installed in grooves 121 to reduce leakage if they can be made effective at the high pressure required for the fuel atomization.

Sleeve bearing 85 on piston pin 86 reduce friction and corrosion to provide durability while providing flexible power transfer between piston 11 and connecting rod 83. Sleeve bearing 13 acts as a durable support for crankshaft 47 in cylinder block 25. Sleeve bearing 26 supports camshaft 15 in either the cylinder head 91 or in cylinder block 25 depending on construction. Sleeve bearing 20 supports movement of rocker arm shaft 19 in cylinder head 91.

Coordination must be maintained between cam lobe 15 of camshaft 31, valve ports of valve 1, and crankshaft 47 so that poppet valve 28 opens every second rotation of the crankshaft 47 to freely permit air to be drawn or pushed into the cylinder 90 during the downward motion of piston 11, while maintaining a tight seal of exhaust valves 24 on it's valve seat in cylinder head 33 by nested coil springs 23 retained by valve stem fastener 22 securely fastened to top of valve 24. A valve guide 92 provides support, lubrication, and oil seal support in cylinder head 33. The exhaust valve must be opened during the upward travel of piston 11 during the same crankshaft rotation and just prior, with some degree of overlap, of opening of intake poppet valve 28. The air is channeled by intake manifold 30 to the cylinder head 91. The exhaust manifold 29 channels the exhaust from the cylinder head 91. Cylinder head cover 21 prevents oil splash loses as does oil pan 50 covering the crankshaft.

The power stroke, when air is compressed, fuel injected, and mixture spontaneous combustion and expansion will take place during alternate crankshaft 47 rotations. A system of piston seals 27 and 26 is provided to seal the moving piston 11 with the cylinder wall which could be sleeved in or is the cylinder block 25. The piston rings 27 can consist of a combustion ring and two or more piston wear rings.

To get the combustion cycle initiated the crankshaft 47 is rotated by electric motor 14 powered by a battery or other electric supply. The starter usually centrifugally engages a pinion in mesh with a ring gear and flywheel 93 forcing the engine to pace cycle. Hydraulic motor could similarly provide the startup function. Lubrication must be provided to all load bearing and moving parts as the journal bearings by a gear or piston pump with pressure control and filtering of fluid. Cooling of the combustion chamber must be provided by air fins on cylinder block 25 or a system of centrifugal pump, temperature regulation, heat exchanger-radiator, and cylinder block 25 cored passages. The combustion chamber parts can be constructed of adiabatic materials if they are capable of providing the durability required of the engine. In road vehicles the foot pedal 43 provides means for the operator to control the quantity of fuel permitted to enter the combustion processes to control the speed and power output.

Figure 2:
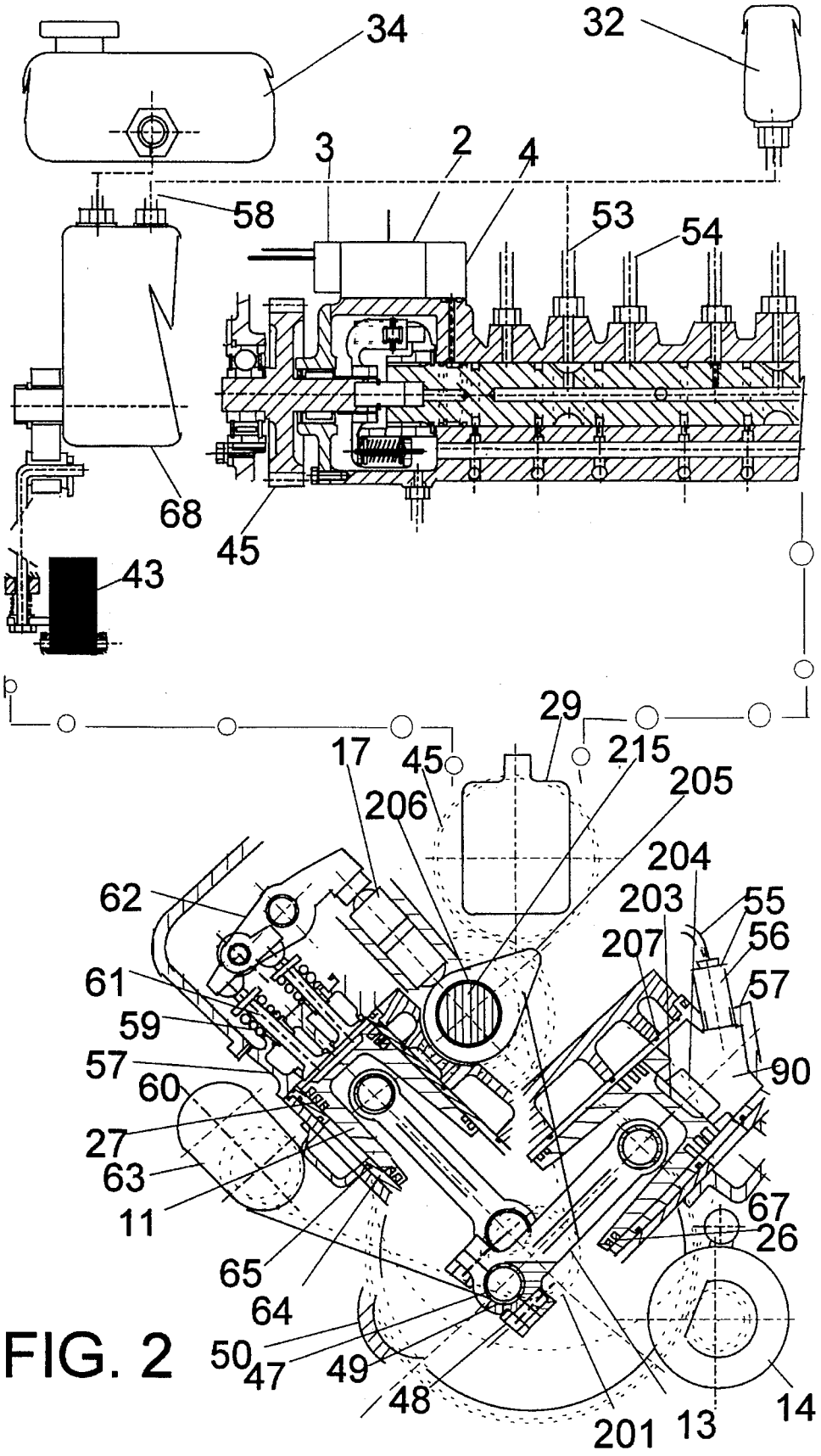
FIG. 2 is a cross-sectional representation of a two cycle synchronized compression ignition engine with synchronized, combustion control unit profected above.

A two cycle synchronized compression ignition engine is designed and constructed much the same as the four cycle with the combustion power taking place every crankshaft 47 rotation as illustrated in FIG. 2. To accomplish a power impulse every stroke of piston 11 the crankshaft 47 must be ratioed one to one to flow into pressurizer pump 68 to control the speed and power output of the engine, other means can be provided when suitable.

A two cycle synchronized compression ignition engine, is designed and constructed much the same as the four cycle, synchronized compression ignition engine with the combustion power taking place every crankshaft 47 rotation as illustrated in FIG. 2. To accomplish a power impulse every stroke of piston 11 the crankshaft 47 must be ratioed one to one to the camshaft 215 and synchronized combustion control unit 29 so that the system is operating at the same rotational speed. The fuel orifice valve 1 must be operated at this same rotational speed so that each cylinder's fuel path is opened to at least accumulator 32 and the engine design maybe to have the pressure pump delivering discharge of fuel to it's respective cylinder at the same instant during peak power conditions.

The by-products of combustion must be released through cored exhaust ports 204 in cylinder or cylinder liner 64 wall during the last several degrees of piston 11 travel approaching and exiting bottom dead center position. The intake air maybe valved by cylinder wall cores also but usually is valved from the cylinder head 57 as the four cycle with one to four poppet valves 61 opened by cams 205 compressing nested, coil springs 59 by action of rocker arms 62 in cylinder head 57. The efficiency of the motor is greatly improved by pressurizing intake manifold air with turbo charger, supercharger, or lobed blower unit 63 powered off the crankshaft 47 by silent chain or power belt. A rugged system of piston rings 27 is required to seal the combustion from the exhaust ports 204. The outer one or two are combustion rings combined with two or three bearing, seal, and wear rings 27 and at the crankcase end two or three oil and wear rings 26.

Sleeve bearings must be provided at all load bearing and motion areas. The connecting rod 13 and sleeve bearing 49 must be securely fastened by bolts 48. Lubrication of wear surfaces and combustion cooling system must be provided as in the four cycle, synchronous, compression ignition engine. Cycle initiation is provided by electric or hydraulic motor 14. High temperature and corrosion resistant seals 207 seal the combustion cylinder liner 64 with the engine block 65 to prevent blow by of combustion gases to the lubrication and leakage of lubricant. The valve train shocks and slack are controlled by lubrication fluid one-way valved in piston valve units 17 with or without intervening connecting rods. A gasket, metal ring, or other type seal between cylinder or cylinder block and cylinder head 57 prevent loss of combustion power. Similarly seals are installed between exhaust manifold 67 and engine block 65.

The design, construction, and operation of the synchronous, combustion control unit 29 is illustrated in FIG. 3 with additional details of rotation, angular, displacement mechanism in FIG. 4. The object to synchronized control of the compression ignition is maintain a compression ratio sufficiently high enough to insure positive auto ignition; to inject well atomized fuel into the hot air during the few rotational degrees that will result in complete combustion; resulting in the highest, working pressure; and with the gas work existing in the cylinder at maximium mechanical positions of the piston 11 to connecting rod 13 and connecting rod 13 to crankshaft 47 relative angles with consideration for all influencing factors of combustion and mechanical linkage.

An objective is to discharge or release pressurized fuel to the combustion process in such a manner as to provide the maximium control under all operating conditions irrespective of number or physical arrangement of cylinders respective of power required, convenience of design, and installation restrictions.

OPERATION OF PREFERRED EMBODIMENT

A greatly improved compression ignition engine results if total control is maintained over the combustion process. The better the control the more power per unit of weight, better the exhaust constituents, better acceleration, higher torque, reduced noise, better durability, etc. The axial, angular displacement mechanism shown in FIG. 3 can control injection of fuel by delaying for more dense air, higher temperatures, smaller fuel charges, slower speed, by compressing together the slide mechanism. The valve groove is delayed opening to the cylinder for the required crankshaft degrees so that charge enters the cylinder so that work of combustion is occurring at greatest mechanical advantage position. Idle is timed very near top dead center of piston so the maximum work of combustion can start the engine with minimum enriching of the mixture.

Opposite effect is calculated by the computer by earlier injection for other parameters. The mechanism is pressurized so the mechanism separates for easier injection at higher speeds (smaller period for combustion), greater loads, higher acceleration, colder air, resulting in a longer interval of combustion. The mean effective work for the fuel charge mixture is positioned at crankangle of maximium mechanical advantage. In order for the valve groove 130 to be retained in relative position to outlet 118 axially in housing 29 a retaining ring 200 is or similar method is required as shown in FIG. 3.

OTHER EMBODIMENTS

Synchronous Spark Ignition Engine - Description

The description and system response of the synchronized compression ignition engine apply for the synchronized spark ignition engine. The major difference results when the mixture is ignited by a spark or charge of electricity at an earlier crankshaft angle than if it were permitted to self ignite from internal energy buildup. The exhaust constituents are considerably different. The maximium combustion pressure and temperature are reduced resulting in lighter construction. The rotation, angular adjuster must contain controls for the fuel input and controls for the spark discharge. These often require separate amounts of adjustment.

Synchronous Spark Ignition Engine - Operation

Every item that can be measured can be adjusted for by the computer and the combustion effected appropriately. This is true for all engines including two and four stroke compression ignition, two and four stroke spark ignition, and for rotary lobe engines whether compression or spark ignition.

CONCLUSION, RAMIFICATION AND SCOPE

Accordingly, it can be seen that synchronized compression engines possessing complete control over the combustion process results in greater efficiency, power to weight ratio, better responsiveness, and smoother operation while also providing less exhaust and providing some control over the chemical constituents.

Although the description above contains many specificities, these should not be construed as limiting the scope of the invention but as merely providing illustrations of some of the presently preferred embodiments of this invention.

Various other embodiments and ramifications are possible within it's scope. For example, combustion can be pre-initiated by an electronic spark along with the pressure atomized fuel input to alter the exhaust chemical constituents, reduce maximium pressure, and reduce structural weight. Also rotary lobe, engine constructions, synchronous compression and spark ignition, can like wise be manufactured with parallel results. Synchronized engines would require special sealing measures to be fully capable of inputting natural gas, LP gas, or vapor fuels, however the operating principles remain.

From the preceding description, it will become apparent that the system is designed in various ways to produce the purpose for which it was intended, and although I have various ways of accomplishing the objective, I am fully cognizant of the fact that many additional changes maybe made without effecting the operativeness of the device, and I reserve the right to make such changes without departing from the spirit of my invention, or the scope of the claims. Thus, the foregoing description and drawings merely explain and illustrate the invention and the invention is not limited thereto.

Thus the scope of the invention should be determined by the appended claims and their legal equivalents, rather than by the examples given.

What is claimed is:

1. A rotary fuel distributor for an internal combustion engine comprising:

a rotary valve mounted in a housing, said housing having a fuel inlet and at least one fuel outlet, fuel flow between said inlet and said at least one outlet controlled by at least one groove in said valve;

means for driving said rotary valve at a speed proportional to engine crankshaft speed;

timing adjuster means located between said rotary vave and said means for driving for varying for the relative angle therebetween and thereby an angle of fuel injection;

sensor means for detecting engine conditions;

means responsive to the sensor means for controlling the timing adjuster means to vary the crank angle of fuel injection.

2. The rotary fuel injection distributor of claim 1 wherein said fuel inlet is connected to a fuel pressure accumulator.

* * * * *